US011625057B2

(12) United States Patent
Matsuo

(10) Patent No.: US 11,625,057 B2
(45) Date of Patent: Apr. 11, 2023

(54) VOLTAGE REGULATOR PROVIDING QUICK RESPONSE TO LOAD CHANGE

(71) Applicant: United Semiconductor Japan Co., Ltd., Kuwana (JP)

(72) Inventor: Yoshihiko Matsuo, Kuwana (JP)

(73) Assignee: United Semiconductor Japan Co., Ltd., Kuwana (JP)

( * ) Notice: Subject to any disclaimer, the term of this patent is extended or adjusted under 35 U.S.C. 154(b) by 49 days.

(21) Appl. No.: 17/191,719

(22) Filed: Mar. 4, 2021

(65) Prior Publication Data

US 2022/0283600 A1 Sep. 8, 2022

(51) Int. Cl.
*G05F 1/575* (2006.01)
*G05F 1/59* (2006.01)
*G05F 1/565* (2006.01)

(52) U.S. Cl.
CPC ..... *G05F 1/59* (2013.01); *G05F 1/575* (2013.01)

(58) Field of Classification Search
CPC ..... G05F 1/565; G05F 1/575; G05F 1/59
See application file for complete search history.

(56) References Cited

U.S. PATENT DOCUMENTS 5,545,977 A 8/1996 Yamada
8,080,984 B1 * 12/2011 Geynet ..... G05F 1/56 323/280
9,608,537 B1 * 3/2017 Lee ..... H02J 5/005
2001/0019278 A1 9/2001 Sudo
2002/0130646 A1 * 9/2002 Zadeh ..... G05F 1/575 323/275
2003/0173594 A1 9/2003 Sudo
2007/0057660 A1 * 3/2007 Lin ..... G05F 1/575 323/316
2007/0257644 A1 * 11/2007 McLeod ..... G05F 1/565 323/273
2008/0180074 A1 * 7/2008 Einerman ..... G05F 1/575 323/280

(Continued)

FOREIGN PATENT DOCUMENTS

JP 11-68039 A 3/1999
JP 2002-116829 A 4/2002

(Continued)

*Primary Examiner* — Sisay G Tiku
(74) *Attorney, Agent, or Firm* — Winston Hsu

(57) ABSTRACT

A voltage regulator includes an operational amplifier, a first transistor, a second transistor, a capacitor and a current sink circuit. The operational amplifier outputs a control voltage according to an amplified differential voltage between a first input terminal and a second input terminal of the operational amplifier. The first transistor includes a control terminal receiving the control voltage, a first terminal coupled to a supply terminal, a second terminal providing an output voltage, and a bulk terminal. The second transistor includes a second terminal coupled to the bulk terminal of the first transistor, and a bulk terminal coupled to the supply terminal. The capacitor includes a first terminal coupled to the bulk terminal of the first transistor, and a second terminal receiving the output voltage. The current sink circuit generates a feedback voltage according to the output voltage and output the feedback voltage to the operational amplifier.

15 Claims, 11 Drawing Sheets

(56) References Cited

U.S. PATENT DOCUMENTS

| | | | | |
|---|---|---|---|---|
| 2012/0001604 | A1* | 1/2012 | Lee | G05F 1/575 323/273 |
| 2013/0234687 | A1 | 9/2013 | Fujimura | |
| 2016/0187902 | A1* | 6/2016 | Zeng | G05F 1/575 323/280 |
| 2016/0291618 | A1* | 10/2016 | Wismar | G05F 1/575 |
| 2017/0220059 | A1* | 8/2017 | Kadowaki | G05F 1/575 |
| 2018/0017984 | A1* | 1/2018 | Mayer | G05F 1/575 |
| 2021/0096587 | A1* | 4/2021 | Shreepathi Bhat | G05F 1/59 |
| 2021/0373588 | A1* | 12/2021 | Wang | G05F 1/59 |
| 2022/0019253 | A1* | 1/2022 | Zukowski | G05F 1/468 |
| 2022/0147081 | A1* | 5/2022 | Wang | H04N 5/35572 |

FOREIGN PATENT DOCUMENTS

| | | | | |
|---|---|---|---|---|
| JP | 2003-100078 | A | | 4/2003 |
| JP | 2003-347913 | A | | 12/2003 |
| JP | 2003347913 | A | * | 12/2003 |
| JP | 2004-94788 | A | | 3/2004 |
| JP | 2006-134268 | A | | 5/2006 |
| JP | 2006134268 | A | * | 5/2006 |
| JP | 2010-217964 | A | | 9/2010 |
| JP | 2013-186735 | A | | 9/2013 |

* cited by examiner

VOLTAGE REGULATOR PROVIDING QUICK RESPONSE TO LOAD CHANGE

BACKGROUND OF THE INVENTION

1. Field of the Invention

The invention relates to power circuits, and specifically, to voltage regulators providing quick responses to load changes.

2. Description of the Prior Art

A voltage regulator is a device designed to automatically maintain a constant voltage level, and has found wide applications in power supplies of electronic devices, computing devices, mobile devices, portable devices, home appliances and others. For applications in wearable devices, the voltage regulator is required to consume less power to achieve a long service life, and is required to adopt a smaller output capacitor or a capacitor-less configuration to reduce manufacturing costs. One solution to achieve low power-consumption is to apply an output transistor with a lower current drivability in the voltage regulator. Nevertheless, the output transistor with the lower current drivability and the smaller output capacitor may result in a lower circuit response.

SUMMARY OF THE INVENTION

According to an embodiment of the invention, a voltage regulator includes an operational amplifier, a first transistor, a second transistor, a first capacitor and a current sink circuit. The operational amplifier includes a first input terminal, a second input terminal and an output terminal. The output terminal outputs a control voltage according to an amplified differential voltage between the first input terminal and the second input terminal. The first transistor includes a control terminal coupled to the output terminal of the operational amplifier, a first terminal coupled to a supply terminal, a second terminal providing an output voltage to a load terminal, and a bulk terminal. The second transistor includes a control terminal coupled to the output terminal of the operational amplifier, a first terminal coupled to the supply terminal, a second terminal coupled to the bulk terminal of the first transistor, and a bulk terminal coupled to the supply terminal. The first capacitor includes a first terminal coupled to the bulk terminal of the first transistor and the second terminal of the second transistor, and a second terminal coupled to the second terminal of the first transistor. The current sink circuit is coupled to the second terminal of the first transistor, the second terminal of the first capacitor, the second input terminal of the operational amplifier and a ground terminal.

According to another embodiment of the invention, a voltage regulator includes an operational amplifier, a first transistor, a second transistor, a first capacitor and a current sink circuit. The operational amplifier includes a first input terminal, a second input terminal, a first output terminal and a second output terminal. The first output terminal outputs a first control voltage according to an amplified differential voltage between the first input terminal and the second input terminal, and the second output terminal outputs a second control voltage according to the amplified differential voltage between the first input terminal and the second input terminal. The first transistor includes a control terminal coupled to the first output terminal of the operational amplifier, a first terminal coupled to a supply terminal, a second terminal providing an output voltage to a load terminal, and a bulk terminal. The second transistor includes a control terminal coupled to the first output terminal of the operational amplifier, a first terminal coupled to the supply terminal, a second terminal coupled to the bulk terminal of the first transistor, and a bulk terminal coupled to the supply terminal. The first capacitor includes a first terminal coupled to the bulk terminal of the first transistor and the second terminal of the second transistor, and a second terminal coupled to the second terminal of the first transistor. The current sink circuit is coupled to the second terminal of the first transistor, the second terminal of the first capacitor, the second input terminal of the operational amplifier, the second output terminal of the operational amplifier and a ground terminal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
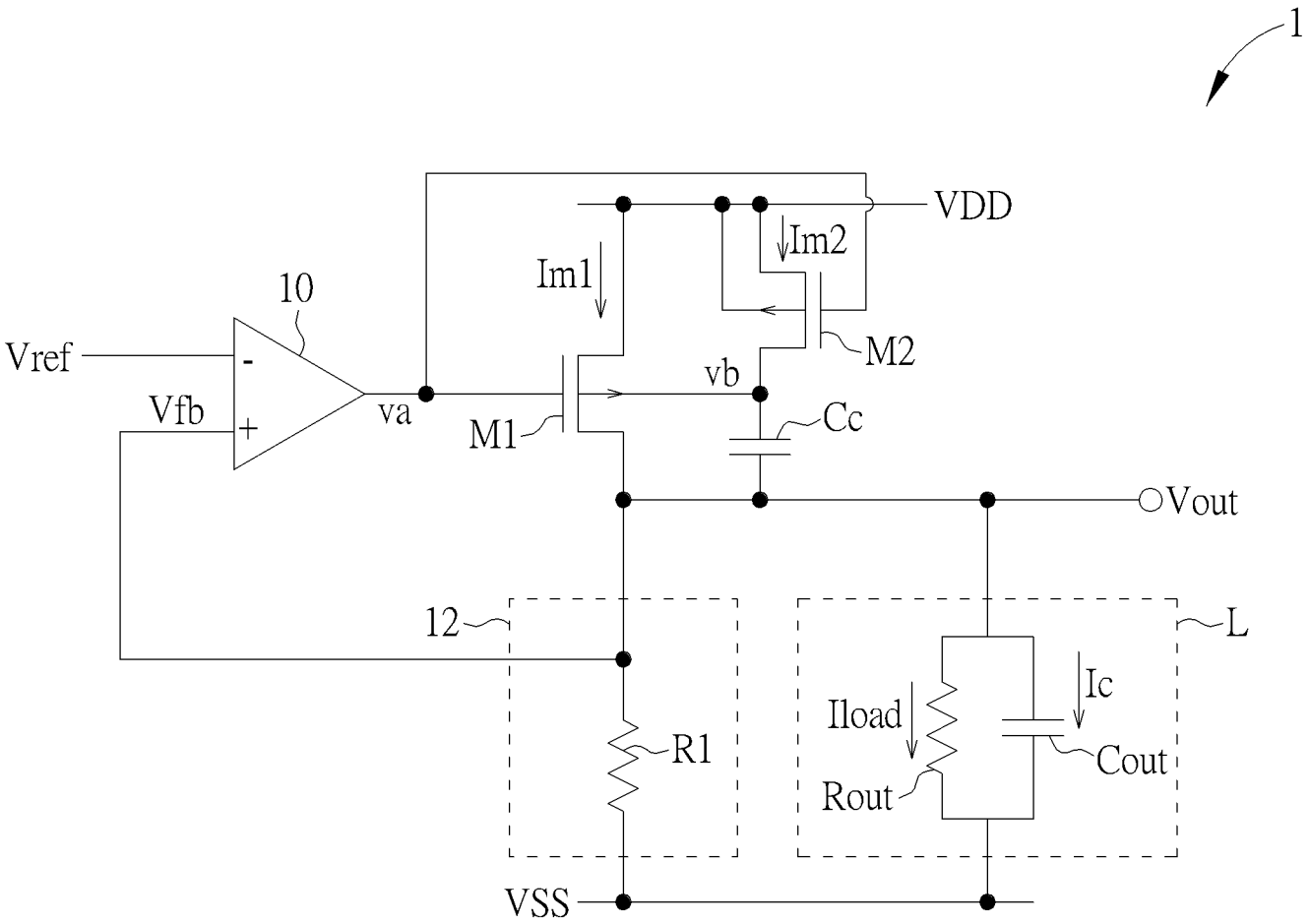
FIG. 1 is a circuit schematic of a voltage regulator according to an embodiment of the invention.

FIG. 1 is a circuit schematic of a voltage regulator 1 according to an embodiment of the invention. The voltage regulator 1 may supply an output voltage Vout to a load L, and maintain the output voltage Vout at a predetermined level regardless of the load condition. The predetermined level may be substantially constant. The load L may be a processor of computing device. The processor may operate in an active mode or a sleep mode. In the active mode, the processor may consume a high current from the voltage regulator 1, and the voltage regulator 1 may operate in a heavy load condition. In the sleep mode, the processor may consume a low current from the voltage regulator 1, and the voltage regulator 1 may operate in a light load condition. When switching from the light load condition to the heavy load condition, the load L will consume an excessive amount of the current from the voltage regulator 1, resulting in a sudden drop in the output voltage Vout. Conversely, when switching from the heavy load condition to the light load condition, the load L will consume a reduced amount of the current from the voltage regulator 1, resulting in a sudden rise in the output voltage Vout. The sudden change in the output voltage Vout may be less than 100 mV. Depend on a scale of the load, the sudden change in the output voltage Vout may be equal to or more than 100 mV. The voltage regulator 1 may adjust the current flowing into the load L in response to the change of the output voltage Vout in a prompt manner.

The voltage regulator 1 may include an operational amplifier 10, a transistor M1, a transistor M2, a capacitor Cc and a current sink circuit 12. The operational amplifier 10 includes a first input terminal, a second input terminal and an output terminal. The transistor M1 includes a control terminal coupled to the output terminal of the operational amplifier 10, a first terminal coupled to a supply terminal, a second terminal providing an output voltage Vout to a load terminal of the load L, and a bulk terminal. The supply terminal may supply a substantially constant supply voltage VDD. The transistor M2 includes a control terminal coupled to the output terminal of the operational amplifier 10, a first terminal coupled to the supply terminal, a second terminal coupled to the bulk terminal of the transistor M1, and a bulk terminal coupled to the supply terminal. The capacitor Cc includes a first terminal coupled to the bulk terminal of the transistor M1 and the second terminal of the transistor M2, and a second terminal coupled to the second terminal of the transistor M1. The current sink circuit 12 is coupled to the second terminal of the transistor M1, the second terminal of the capacitor Cc, the second input terminal of the operational amplifier 10 and a ground terminal. The ground terminal may supply a substantially constant ground voltage VSS. The load L may include the load terminal, a resistor Rout and a capacitor Cout. The resistor Rout includes a first terminal coupled to the load terminal, and a second terminal coupled to the ground terminal. The capacitor Cout includes a first terminal coupled to the load terminal, and a second terminal coupled to the ground terminal.

The current sink circuit 12 may include a resistor R1. The resistor R1 includes a first terminal coupled to the second terminal of the transistor M1, the second terminal of the capacitor Cc and the second input terminal of the operational amplifier 10, and a second terminal coupled to the ground terminal. The resistor R1 may provide a current sink path to sink excessive current to the ground terminal.

The transistor M1 may generate a current Im1 according to a control voltage va. The current Im1 may include a current Ic charging the capacitor Cout and the current Iload flowing through the resistor Rout. The transistor M1 may be a P-type metal oxide semiconductor field effect transistor (MOSFET) having a threshold voltage Vthp. When the control voltage va is lower than the difference between the supply voltage VDD and an absolute value of the threshold voltage |Vthp|, the transistor M1 will be turned on to generate the current Im1. The magnitude of the current Im1 may be a function of a difference between the supply voltage VDD and the control voltage va. In other words, the larger current Im1 will be provided by the lower control voltage va. When the control voltage va is higher than the difference between the supply voltage VDD and the absolute value of the threshold voltage |Vthp|, the transistor M1 will be turned off to stop generating the current Im1.

The first input terminal of the operational amplifier 10 may receive a reference voltage Vref. The reference voltage Vref may be fixed in value. The second input terminal of the operational amplifier 10 may receive a feedback voltage Vfb. The feedback voltage Vfb may be controlled to be equal to the reference voltage Vref. The output terminal of the operational amplifier 10 may output a control voltage va according to an amplified differential voltage between the first input terminal and the second input terminal. The first input terminal of the operational amplifier 10 may be an inverting input terminal, the second input terminal of the operational amplifier 10 may be a non-inverting input terminal. The feedback voltage Vfb may be positively correlated to the output voltage Vout. In the embodiment, the feedback voltage Vfb may be equal to the output voltage Vout. The operational amplifier 10 may generate the control voltage va according to a difference between the feedback voltage Vfb and the reference voltage Vref. When there is a sudden drop in the output voltage Vout, the feedback voltage Vfb may decrease accordingly. When the feedback voltage Vfb decreases, the difference between the feedback voltage Vfb and the reference voltage Vref may increase (when the feedback voltage Vfb is less than the reference voltage Vref, the result of subtracting Vref from Vfb may be negative for the operational amplifier 10), and the control voltage va may decrease. As a result of decreasing of the control voltage va, the current Im1 may further increase by turning on the transistor M1. Therefore, the sudden drop in the output voltage Vout may be compensated and the output voltage Vout may be maintained at the predetermined level. Conversely, when there is a sudden rise in the output voltage Vout, the feedback voltage Vfb may increase accordingly. When the feedback voltage Vfb increases, the difference between the feedback voltage Vfb and the reference voltage Vref may increase (when the feedback voltage Vfb is greater than the reference voltage Vref, the result of subtracting Vref from Vfb may be positive for the operational amplifier 10), the control voltage va may increase. As a result of increasing the control voltage va, the current Im1 may be further lessened by weak turn-on transistor M1 or may even stop to supply turning off the transistor M1 all together. Therefore, the sudden rise in the output voltage Vout may be compensated and the output voltage Vout may be maintained at the predetermined level. Accordingly, generation of the control voltage va is dependent on the difference between the feedback voltage Vfb and the reference voltage Vref, and convergence of the control voltage va may be time-consuming, slowing down the response of the voltage regulator 1 to the change of the output voltage Vout.

Therefore, the transistor M2 and the capacitor Cc are incorporated to speed up the response of the voltage regulator 1 for maintaining the output voltage Vout at the predetermined level upon a sudden change of the output voltage Vout. The transistor M2 may be a P-type MOSFET and may serve as a resistor. In the light load condition, the control voltage va may be large, and therefore, the transistor M2 may be turned off or slightly turned on, the resistance of the transistor M2 may be large, and the bulk voltage vb of the transistor M1 is determined largely by the output voltage Vout. In the heavy load condition, the control voltage va may be low and therefore, the transistor M2 may be turned on, the resistance of the transistor M2 may be small, and the bulk voltage vb of the transistor M1 is determined by the supply voltage VDD and the output voltage Vout. The transistor M2 and the capacitor Cc may serve as a time constant circuit configured between the supply terminal, the bulk terminal of the transistor M1 and the second terminal of the transistor M1. Any change in the output voltage Vout may be propagated as the bulk voltage vb at the bulk terminal of the transistor M1 via the capacitor Cc. The threshold voltage Vthp of the transistor M1 may be affected by the bulk voltage vb thereof owing to the body effect, and may be expressed by Equation (1):

$$Vthp=Vthp0+\gamma p(\sqrt{(2*\Phi f-Vsb)}-\sqrt{(2*\Phi f)}) \quad \text{Equation (1)}$$

where Vthp is the threshold voltage of a PMOS device;

Vthp0 is the zero body bias (Vsb=0) voltage of the PMOS device;

γp(<0) is the body effect coefficient of the PMOS device;

Φf of is the Fermi potential of the PMOS device; and

Vsb is the source-to-bulk voltage of the PMOS device.

As indicated in Equation (1), the threshold voltage Vthp is negatively correlated to the source-to-bulk voltage Vsb. A sudden drop in the output voltage Vout may induce a drop in the bulk voltage vb of the transistor M1 via the capacitor Cc, and therefore, the source-to-bulk voltage Vsb of the transistor M1 may increase, and the threshold voltage Vthp of the transistor M1 may decrease, enabling the transistor M1 to increase the current Im1 while keeping control voltage va unchanged, so as to bring up the output voltage Vout and maintain the output voltage Vout at the substantially constant level. A sudden rise in the output voltage Vout may induce a rise in the bulk voltage vb of the transistor M1 via the capacitor Cc, and therefore, the source-to-bulk voltage Vsb of the transistor M1 may decrease, and the threshold voltage Vthp of the transistor M1 may increase, enabling the transistor M1 to decrease the current Im1 while keeping control voltage va unchanged, so as to bring down the output voltage Vout and maintain the output voltage Vout at the substantially constant level.

The capacitance of the capacitor Cc may be selected without affecting the stability of the voltage regulator 1. In some embodiments, the capacitance of the capacitor Cc may be less than one-tenth of the capacitance of the capacitor Cout and may satisfy Equation (2):

$$Cout>>Cc*(W1*L2)/(W2*L1)*\alpha \quad \text{Equation (2)}$$

where Cc is the capacitance of the capacitor Cc;

W1 is the width of the transistor M1;

L1 is the length of the transistor M1;

W2 is the width of the transistor M2;

L2 is the length of the transistor M2;

$$\alpha=|\gamma|/(2*\sqrt{(2*\Phi f-Vsb)});$$

γ is the body effect coefficient;

Φf of is the Fermi potential; and

Vsb is the source-to-bulk voltage.

Figure 2:
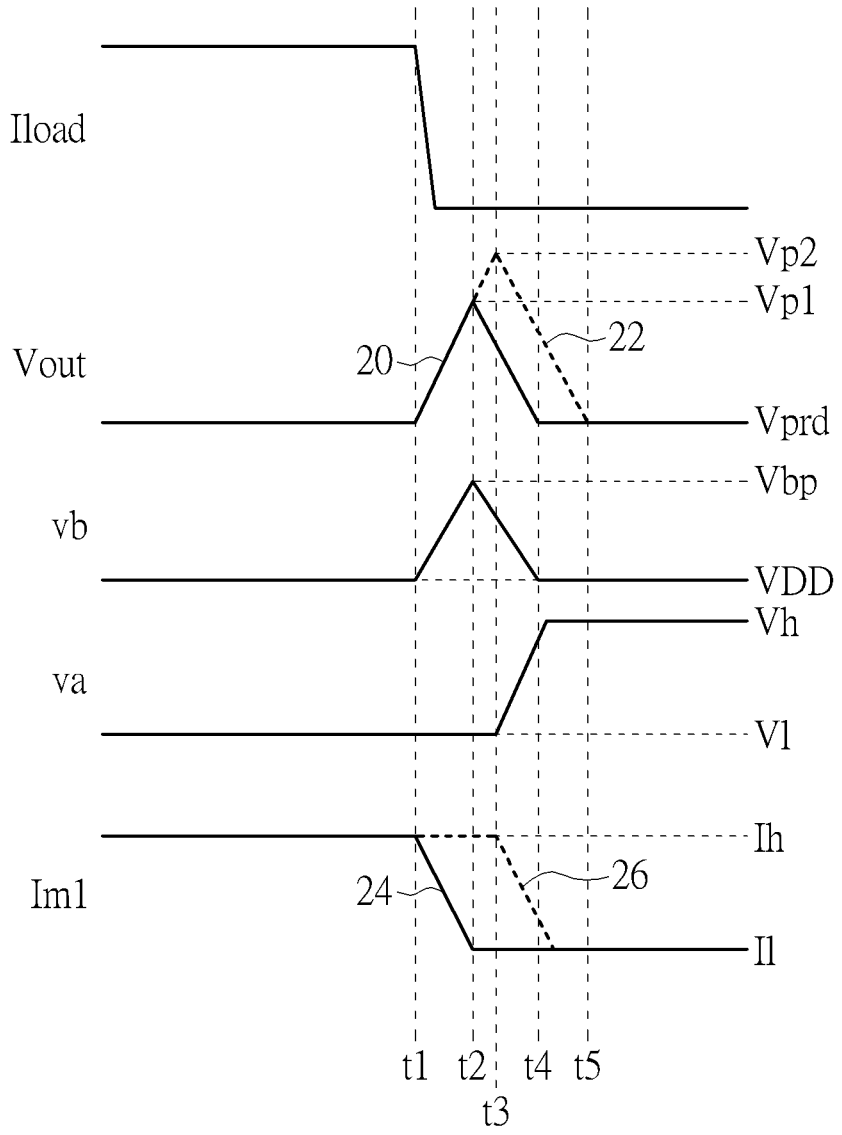
FIG. 2 is waveforms of the voltage regulator in FIG. 1 represented as an exemplary load change condition.

FIG. 2 is waveforms of the voltage regulator 1 represented as an exemplary load change condition. The lines 20 and 22 represent waveforms of the output voltages Vout in the present embodiment and in the related art, respectively, and the lines 24 and 26 represent waveforms of the currents Im1 in the present embodiment and in the related art, respectively.

In the embodiment, at Time t1, the load condition is switched from the heavy load condition to the light load condition. In between Time t1 and Time t2, the load L draws a reduced amount of the current Iload, the waveform 20 of the output voltage Vout rises from a predetermined level Vprd to an output peak level Vp1, the bulk voltage vb increases from the supply voltage VDD to a bulk peak level Vbp, the control voltage va remains at a voltage level Vl, and the waveform 24 of the current Im1 decreases from a current level Ih to a current level Il in response to the increase of the bulk voltage vb, suppressing the rise in the waveform 20 of the output voltage Vout. The supply voltage VDD may be the steady-state level of the bulk voltage vb. In between Time t2 and Time t3, the waveform 20 of the output voltage Vout drops from the output peak level Vp1, the bulk voltage vb drops from the bulk peak level Vbp, the control voltage va remains at the voltage level Vl, and the waveform 24 of the current Im1 remains at the current level Il, suppressing the rise in the waveform 20 of the output voltage Vout. In between Time t3 and Time t4, the waveform 20 of the output voltage Vout continues to drop to the predetermined level Vprd, the bulk voltage vb continues to drop to the supply voltage VDD, the control voltage va starts rising from the voltage level Vl towards a voltage level Vh, and the waveform 24 of the current Im1 remains at the current level Il, pulling the waveform 20 of the output voltage Vout towards the predetermined level Vprd.

In the related art, in between Time t1 and Time t3, the waveform 22 of the output voltage Vout rises from the predetermined level Vprd to an output peak level Vp2, and the control voltage va remains at the voltage level Vl, and the waveform 26 of the current Im1 remains at the current level Ih. The output peak level Vp2 of the waveform 22 may be higher than the output peak level Vp1 of the waveform 20. In between Time t3 and Time t5, the control voltage va rises from the voltage level Vl to the voltage level Vh, and the waveform 26 of the current Im1 decreases from the current level Ih to the current level Il, pulling the waveform 22 of the output voltage Vout to the predetermined level Vprd. In comparison to the related art, the waveform 20 of the output voltage Vout is brought back to the predetermined level Vprd at Time t4, and the waveform 22 of the output voltage Vout is brought back to the predetermined level Vprd at Time t5, and thus the present embodiment responds to the change in the load condition in a prompter manner than the related art.

Figure 3:
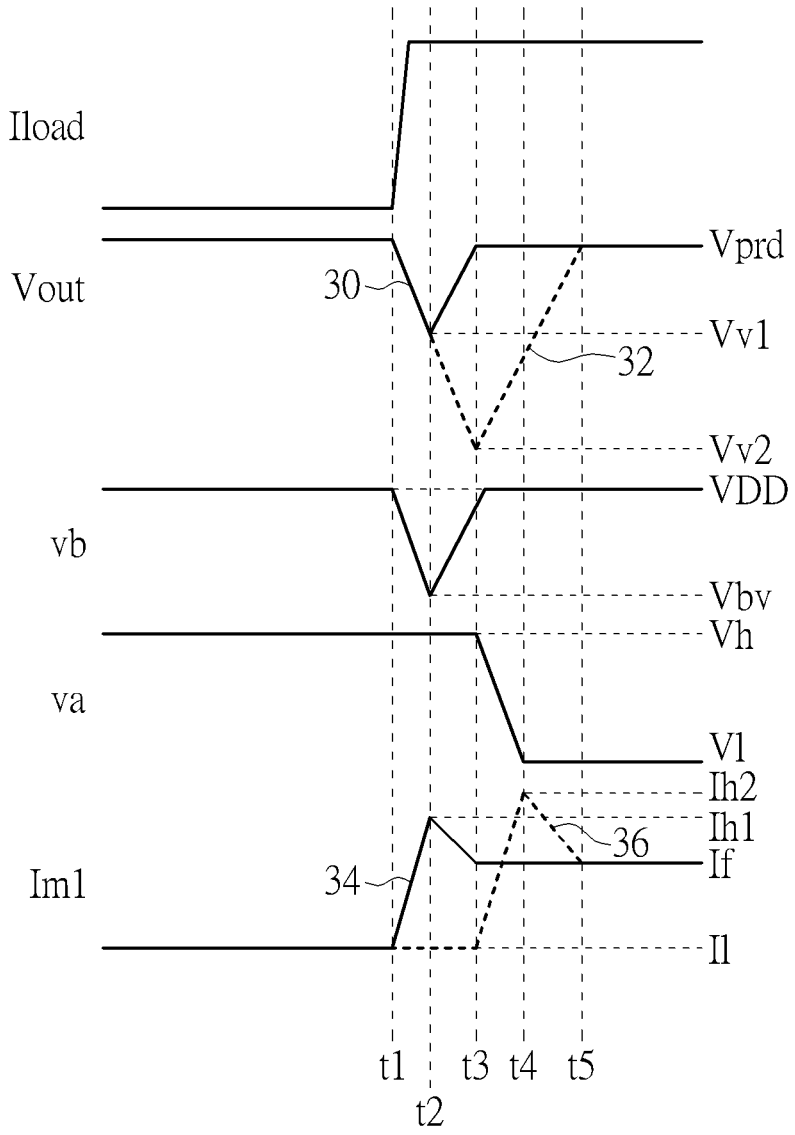
FIG. 3 is waveforms of the voltage regulator in FIG. 1 represented as another exemplary load change condition.

FIG. 3 is waveforms of the voltage regulator 1 represented as another exemplary load change condition. The lines 30 and 32 represent waveforms of the output voltages Vout in the present embodiment and in the related art, respectively, and the lines 34 and 36 represent waveforms of the currents Im1 in the present embodiment and in the related art, respectively.

In the embodiment, at Time t1, the load condition is switched from the light load condition to the heavy load condition. In between Time t1 and Time t2, the load L draws an increased amount of the current Iload, the waveform 30 of the output voltage Vout drops from the predetermined level Vprd to an output valley level Vv1, the bulk voltage vb decreases from the supply voltage VDD to a bulk valley level Vbv, the control voltage va remains at the voltage level Vh, and the waveform 34 of the current Im1 rises from a current level Il to a current level Ih1 in response to the decrease of the bulk voltage vb, compensating for the drop in the waveform 30 of the output voltage Vout. In between Time t2 and Time t3, the waveform 30 of the output voltage Vout rises from the output valley level Vv1 to the predetermined level Vprd, the bulk voltage vb rises from the bulk valley level Vbv towards the supply voltage VDD, the control voltage va remains at the voltage level Vh, and the waveform 34 of the current Im1 drops from the current level Ih1 to a final level If, pulling the waveform 30 of the output voltage Vout towards the predetermined level Vprd. In between Time t3 and Time t4, the control voltage va drops from the voltage level Vh to the voltage level Vl. In between Time t4 and t5, the control voltage va remains at the voltage level Vl, the waveform 34 of the current Im1 remains at the final level If, and the waveform 30 of the output voltage Vout remains at the predetermined level Vprd.

In the related art, in between Time t1 and Time t3, the waveform 32 of the output voltage Vout drops from the predetermined level Vprd to an output valley level Vv2, the control voltage va remains at the voltage level Vh, and the waveform 36 of the current Im1 remains at the current level Il. The output valley level Vv2 may be less than the output valley level Vv1. In between Time t3 and Time t4, the control voltage va drops from the voltage level Vh to the voltage level Vl, and the waveform 36 of the current Im1 increases from the current level Il to a current level Ih2, pulling the waveform 32 of the output voltage Vout from the output valley level Vv2 toward the predetermined level Vprd. In between Time t4 and Time t5, the control voltage va remains at the voltage level Vl, and the waveform 36 of the current Im1 decreases from the current level Ih2 to the final level If, pulling the waveform 32 of the output voltage Vout to the predetermined level Vprd. In comparison to the related art, the waveform 30 of the output voltage Vout is brought back to the predetermined level Vprd at Time t3, and the waveform 32 of the output voltage Vout is brought back to the predetermined level Vprd at Time t5, and thus the present embodiment responds to the change in the load condition in a prompter manner.

Figure 4:
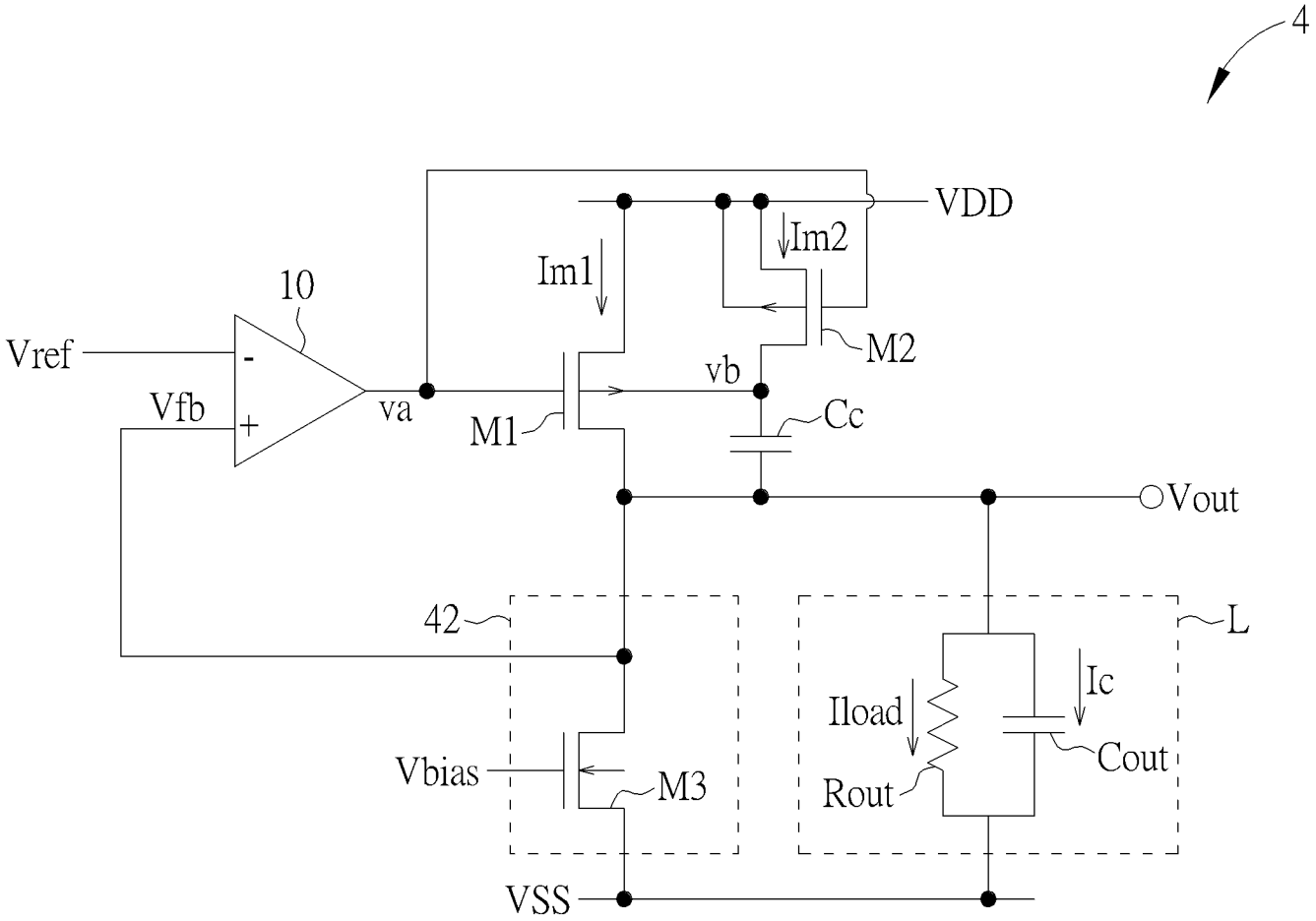
FIG. 4 is a circuit schematic of a voltage regulator according to another embodiment of the invention.

FIG. 4 is a circuit schematic of a voltage regulator 4 according to another embodiment of the invention. The voltage regulator 4 is different from the voltage regulator 1 in that a current sink circuit 42 is used to replace the current sink circuit 12. The voltage regulator 4 operates in a manner similar to the voltage regulator 1, and explanation therefor will be omitted for brevity. The current sink circuit 42 will be explained in details in the following paragraphs.

The current sink circuit 42 includes a transistor M3, the transistor M3 including a first terminal coupled to the second terminal of the transistor M1, the second terminal of the capacitor Cc and the second input terminal of the operational amplifier 10, a second terminal coupled to the ground terminal, a control terminal receiving a fixed bias voltage Vbias, and a bulk terminal coupled to the ground terminal. The transistor M3 may be an N-type MOSFET and may serve as a resistor, with the resistance of the resistor being controlled by the bias voltage Vbias. The transistor M3 may provide a current sink path to sink excessive current to the ground terminal.

Figure 5:
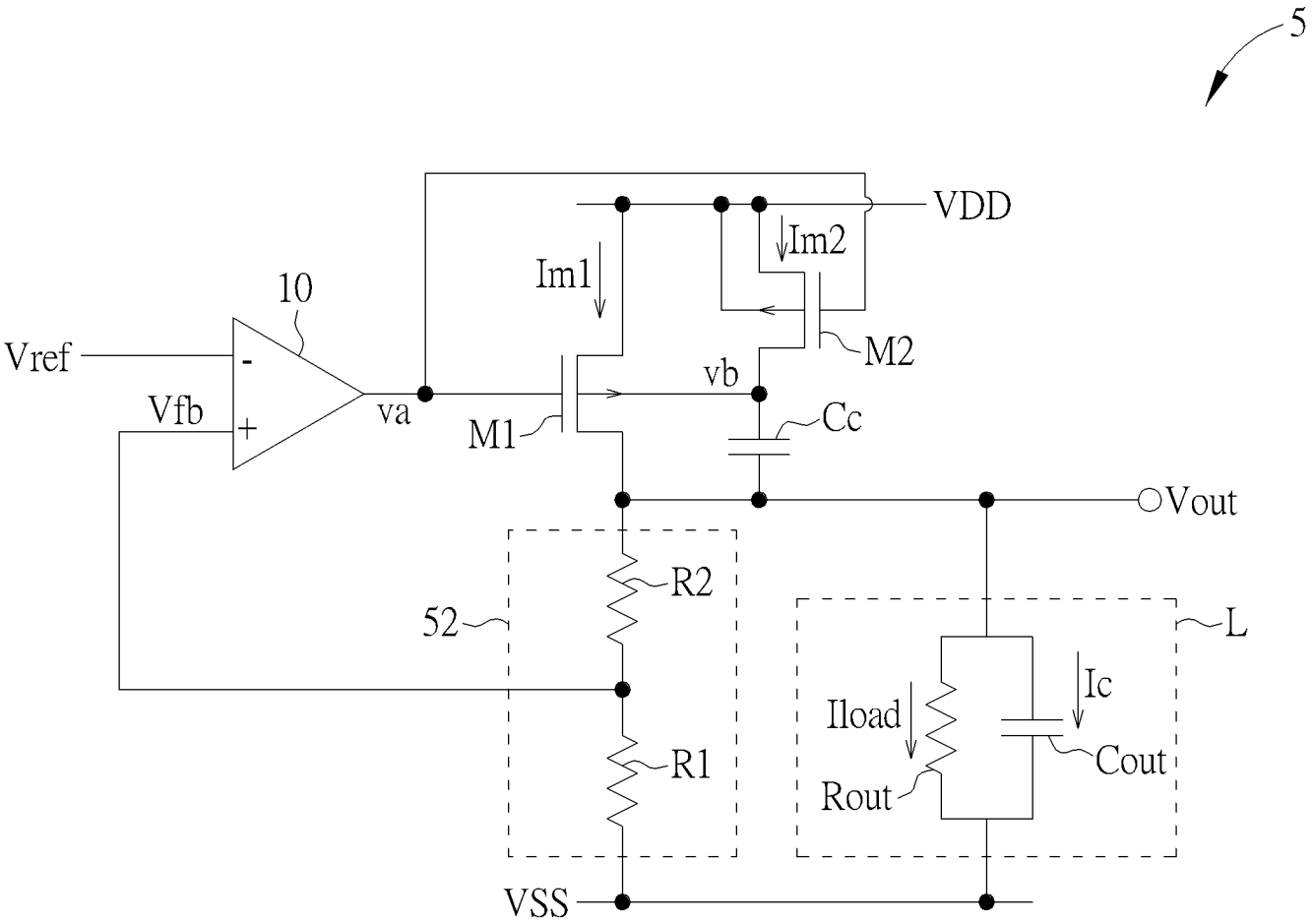
FIG. 5 is a circuit schematic of a voltage regulator according to another embodiment of the invention.

FIG. 5 is a circuit schematic of a voltage regulator 5 according to another embodiment of the invention. The voltage regulator 5 is different from the voltage regulator 1 in that a current sink circuit 52 is used to replace the current sink circuit 12. The voltage regulator 5 operates in a manner similar to the voltage regulator 1, and explanation therefor will be omitted for brevity. The current sink circuit 52 will be explained in details in the following paragraphs.

The current sink circuit 52 may include a resistor R1 and a resistor R2 configured into a voltage divider. The resistor R2 includes a first terminal coupled to the second terminal of the transistor M1 and the second terminal of the capacitor Cc, and the second terminal. The resistor R1 includes a first terminal coupled to the second terminal of the resistor R2 and the second input terminal of the operational amplifier 10, and a second terminal coupled to the ground terminal. The first terminal of the resistor R1 may deliver the feedback voltage Vfb to the operational amplifier 10. The feedback voltage Vfb may be positively correlated to the output voltage Vout and less than the output voltage Vout. In some embodiments, the resistor R1 and the resistor R2 may be implemented by transistors. The voltage regulator 5 may have a regulator gain as expressed by Equation (3):

$$Vout/Vref=(Rb1+Rb2)/Rb1 \quad \text{Equation (3)}$$

where Vout is the output voltage;
Vref is the reference voltage;
Rb1 is the resistance of the resistor R1; and
Rb2 is the resistance of the resistor R2.

Figure 6:
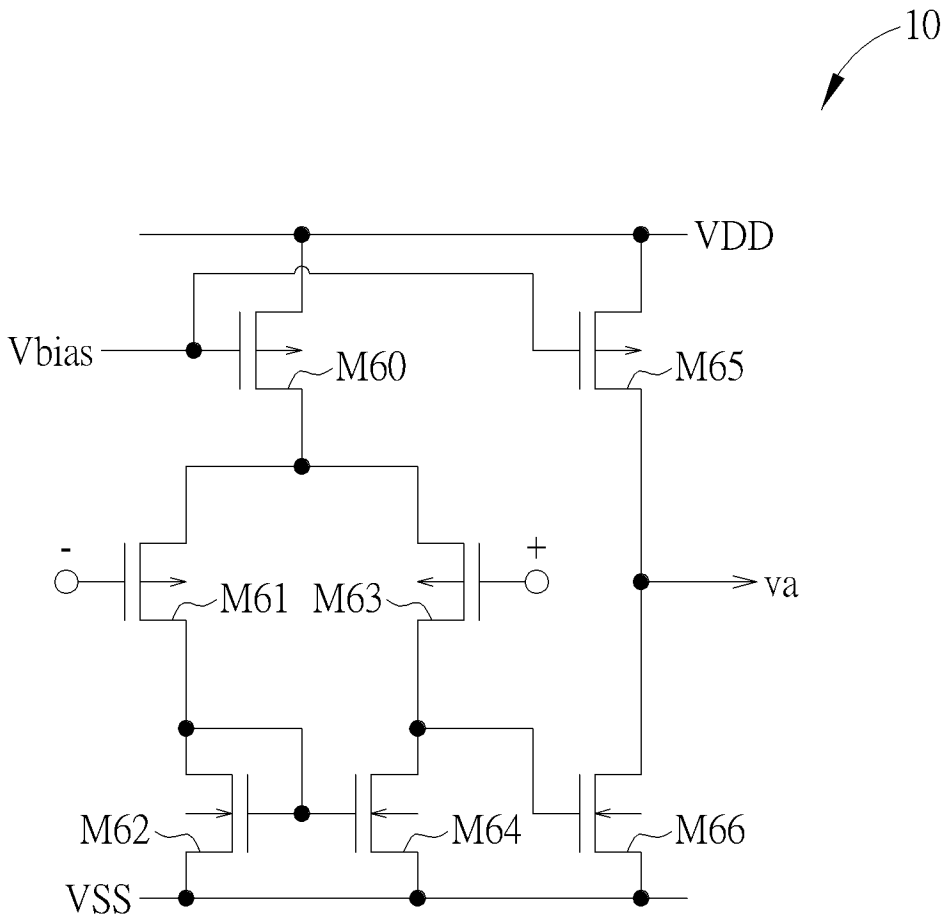
FIG. 6 is a circuit schematic of the operational amplifier according to embodiments illustrated in FIGS. 1, 4 and 5.

FIG. 6 is a circuit schematic of the operational amplifier 10 according to embodiments illustrated in FIGS. 1, 4 and 5. The operational amplifier 10 may include transistors M60 to M66. The transistors M60, M61, M63, M65 may be P-type MOSFETs, and the transistors M62, M64, M66 may be N-type MOSFETs. The transistor M60 includes a control terminal receiving a fixed bias voltage Vbias, a first terminal coupled to the supply terminal and a second terminal. The transistor M65 includes a control terminal receiving the fixed bias voltage Vbias, a first terminal coupled to the supply terminal and a second terminal. The transistors M60, M65 may serve as current sources. The transistor M61 includes a control terminal coupled to the first input terminal of the operational amplifier 10, a first terminal coupled to the second terminal of the transistor M60, and a second terminal. The transistor M63 includes a control terminal coupled to the second input terminal of the operational amplifier 10, a first terminal coupled to the second terminal of the transistor M60, and a second terminal. The transistor M62 includes a control terminal, a first terminal coupled to the control terminal of the transistor M62 and the second terminal of the transistor M61, and a second terminal coupled to the ground terminal. The transistor M64 includes a control terminal coupled to the control terminal of the transistor M62, a first terminal coupled to the second terminal of the transistor M63, and a second terminal coupled to the ground terminal. The transistors M62, M64 may be configured into a current mirror. The transistor M66 includes a control terminal coupled to the first terminal of the transistor M64, a first terminal coupled to the second terminal of the transistor M65, and a second terminal coupled to the ground terminal.

The operational amplifier 10 may receive the reference voltage Vref at the control terminal of the transistor M61, receive the feedback voltage Vfb at the control terminal of the transistor M63, and output the control voltage va at the second terminal of the transistor M65 and the first terminal of the transistor M66. The reference voltage Vref is fixed, and as a consequence, the current passing through the transistor M61 may be equal to the current passing through the transistor M63 in the steady-state (Vref is equal to Vfb.), as described above. The feedback voltage Vfb may vary with the output voltage Vout. As the feedback voltage Vfb decreases, the current passing through the transistor M63 may increase accordingly. The current mirror of the transistor M62 and the transistor M64 forces the currents passing through the transistor M62 and the transistor M64 to be equal, and therefore, the excess current in the current passing through the transistor M63 may be diverted to the control terminal of the transistor M66 and may increase a voltage of the control terminal of the transistor M66, lowering the control voltage va at the first terminal of the transistor M66. As a result, the control voltage va of the operational amplifier 10 may decrease, because of increasing current passing through the transistor M66 by increasing the voltage of the control terminal of the transistor M66. As the feedback voltage Vfb increases, the current passing through the transistor M63 may decrease accordingly. The current mirror of the transistor M62 and the transistor M64 forces the currents passing through the transistor M62 and the transistor M64 to be equal, and therefore, the deficiency current in the current passing through the transistor M63 may be diverted to the control terminal of the transistor M66 and may decrease a voltage of the control terminal of the transistor M66, establishing the control voltage va at the first terminal of the transistor M66. As a result, the control voltage va of the operational amplifier 10 may increase, because of decreasing current passing through the transistor M66 by decreasing the voltage of the control terminal of the transistor M66.

The embodiments in FIGS. 1, 4 and 5 employ the transistor M2 and the capacitor Cc to adjust the bulk voltage vb of the transistor M1 upon a sudden change in the output voltage Vout, being quick in circuit response, and reducing output voltage variations owing to changes in load condition.

Figure 7:
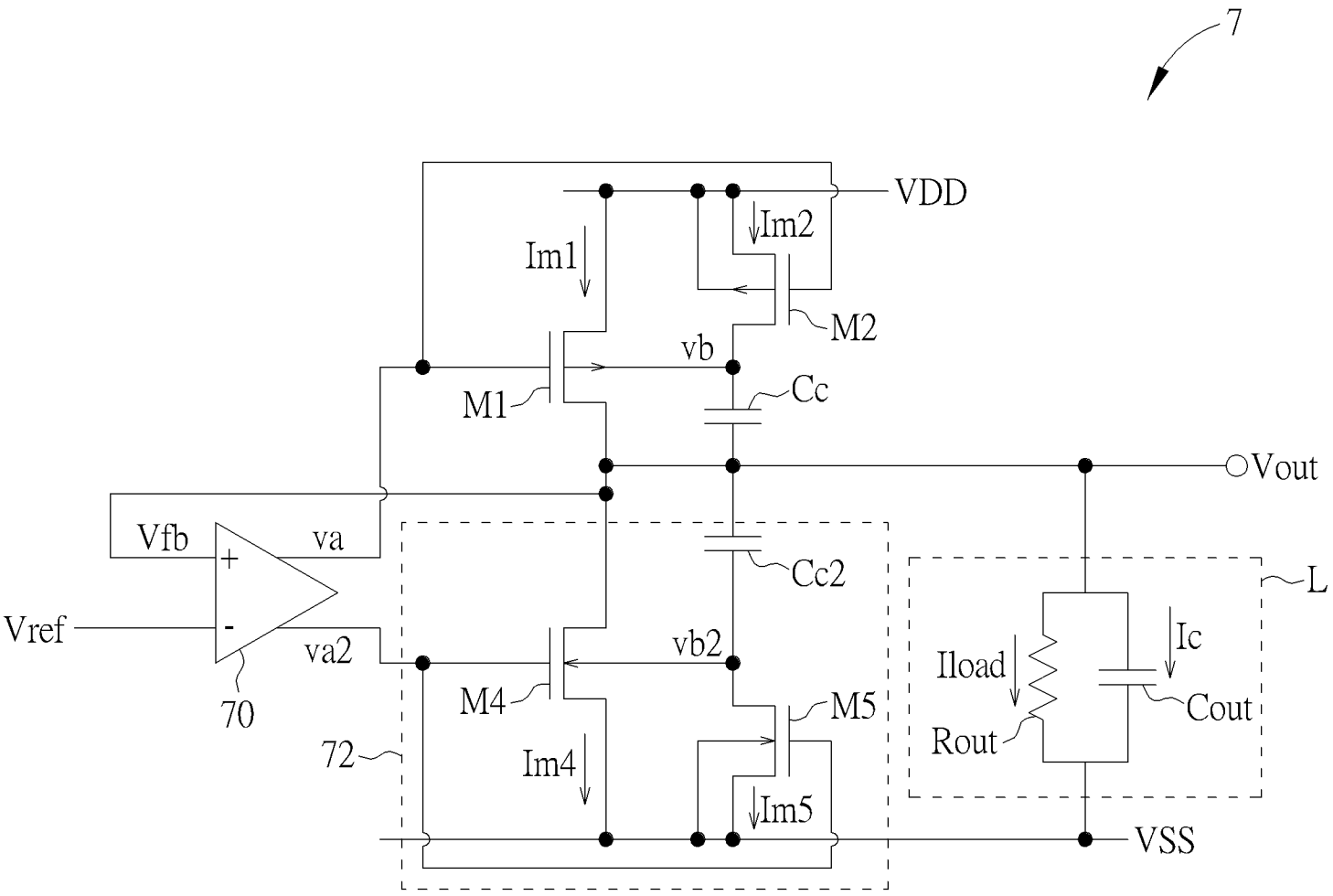
FIG. 7 is a circuit schematic of a voltage regulator according to another embodiment of the invention.

FIG. 7 is a circuit schematic of a voltage regulator 7 according to another embodiment of the invention. The voltage regulator 7 is different from the voltage regulator 1 in that a current sink circuit 72 is used to replace the current sink circuit 12 and an operational amplifier 70 is used to replace the operational amplifier 10. The transistors M1, M2 and the capacitor Cc in voltage regulator 7 operate in a manner similar to those in the voltage regulator 1, and explanation therefor will be omitted for brevity. The operational amplifier 70 and the current sink circuit 72 will be explained in details in the following paragraphs.

The operational amplifier 70 includes a first input terminal, a second input terminal, a first output terminal and a second output terminal. The first input terminal of the operational amplifier 70 may receive the fixed reference voltage Vref. The second input terminal of the operational amplifier 70 may receive the feedback voltage Vfb. The first input terminal of the operational amplifier 70 may be an inverting input terminal, and the second input terminal of the operational amplifier 70 may be a non-inverting input terminal. The first output terminal of the operational amplifier 70 may output a first control voltage va according to an amplified differential voltage between the first input terminal and the second input terminal, and the second output terminal of the operational amplifier 70 may output a second control voltage va2 according to the amplified differential voltage between the first input terminal and the second input terminal. The first control voltage va may be identical to or different from the second control voltage va2. The current sink circuit 72 may be coupled to the second terminal of the transistor M1, the second terminal of the capacitor Cc, the second input terminal of the operational amplifier 70, the second output terminal of the operational amplifier 70 and a ground terminal.

The current sink circuit 72 may include a transistor M4, a transistor M5 and a capacitor Cc2. The transistor M4 includes a control terminal coupled to the second output terminal of the operational amplifier 70, a first terminal coupled to the second terminal of the transistor M1, a second terminal coupled to the ground terminal, and a bulk terminal. The first terminal of the transistor M4 may provide the output voltage Vout to the load terminal of the load L. The transistor M5 includes a control terminal coupled to the second output terminal of the operational amplifier 70, a first terminal coupled to the bulk terminal of the transistor M4, a second terminal coupled to the ground terminal, and a bulk terminal coupled to the ground terminal. The capacitor Cc2 includes a first terminal coupled to the first terminal of the transistor M4, and a second terminal coupled to the bulk terminal of the transistor M4 and the first terminal of the transistor M5. The second terminal of the transistor M1 and the first terminal of the transistor M4 provide the feedback voltage Vfb to the second input terminal of the operational amplifier 70. The transistor M1 and the transistor M2 may be P-type MOSFETs, and the transistor M4 and transistor M5 may be N-type MOSFETs.

When the load condition switches from the heavy load condition to the light load condition, the current sink circuit 72 may provide a current sink path to sink the excessive current to the ground terminal, suppressing the sudden rise in the output voltage Vout. Likewise, when the load condition switches from the light load condition to the heavy load condition, the current sink circuit 72 may reduce the sudden drop in the output voltage Vout. The transistor M4 may generate a current Im4 according to the second control voltage va2. The current Im4 may satisfy the Equation (4):

$$Iload = Im1 - Ic - Im4 \qquad \text{Equation (4)}$$

where Iload is the current flowing through the resistor Rout;
Im1 is the drain current generated by the transistor M1;
Ic is the current charging the capacitor Cout; and
Im4 is the drain current generated by the transistor M4.

The transistor M4 has a threshold voltage Vthn. When the second control voltage va2 is higher than the difference between the threshold voltage Vthn and the ground voltage VSS, the transistor M4 will be turned on to generate the current Im4. The magnitude of the current Im4 may be a function of a difference between the second control voltage va2 and the ground voltage VSS. In other words, the larger current Im4 will be provided by the higher second control voltage va2. When the second control voltage va2 is lower than the difference between the threshold voltage Vthn and the ground voltage VSS, the transistor M4 will be turned off to stop generating the current Im4.

The transistor M5 and the capacitor Cc2 are incorporated to speed up the response of the voltage regulator 7 for maintaining the output voltage Vout at the predetermined level Vprd upon a sudden change of the output voltage Vout. The transistor M5 may serve as a resistor. The transistor M5 and the capacitor Cc2 may serve as a time constant circuit configured between the ground terminal, the bulk terminal of the transistor M4 and the first terminal of the transistor M4. Any change in the output voltage Vout may be propagated as the bulk voltage vb2 at the bulk terminal of the transistor M4 via the capacitor Cc2. The threshold voltage Vthn of the transistor M4 may be affected by the bulk voltage vb2 thereof owing to the body effect, and may be expressed by Equation (5):

$$Vthn = Vthn0 + \gamma n(\sqrt{(2*\Phi f + Vsb)} + \sqrt{(2*\Phi f)}) \qquad \text{Equation (5)}$$

where Vthn is the threshold voltage of a NMOS device;
Vthn0 is the zero body bias (Vsb=0) voltage of the NMOS device;
γn(>0) is the body effect coefficient of the NMOS device;
Φf of is the Fermi potential of the NMOS device; and
Vsb is the source-to-bulk voltage.

The threshold voltage Vthn is positively correlated to the source-to-bulk voltage Vsb. A sudden rise in the output voltage Vout may induce a rise in the bulk voltage vb2 of the transistor M4 via the capacitor Cc2, and therefore, the source-to-bulk voltage Vsb of the transistor M4 may decrease, and the threshold voltage Vthn of the transistor M4 may decrease, enabling the transistor M4 to increase the current Im4 while keeping second control voltage va2 unchanged, sinking the excessive current to the ground terminal and bringing down the output voltage Vout to maintain the output voltage Vout at the substantially constant level. A sudden drop in the output voltage Vout may induce a drop in the bulk voltage vb2 of the transistor M4 via the capacitor Cc2, and therefore, the source-to-bulk voltage Vsb of the transistor M4 may increase, and the threshold voltage Vthn of the transistor M4 may increase, enabling the transistor M4 to decrease the current Im4 while keeping second control voltage va2 unchanged, so as to maintain the output voltage Vout at the substantially constant level.

Figure 8:
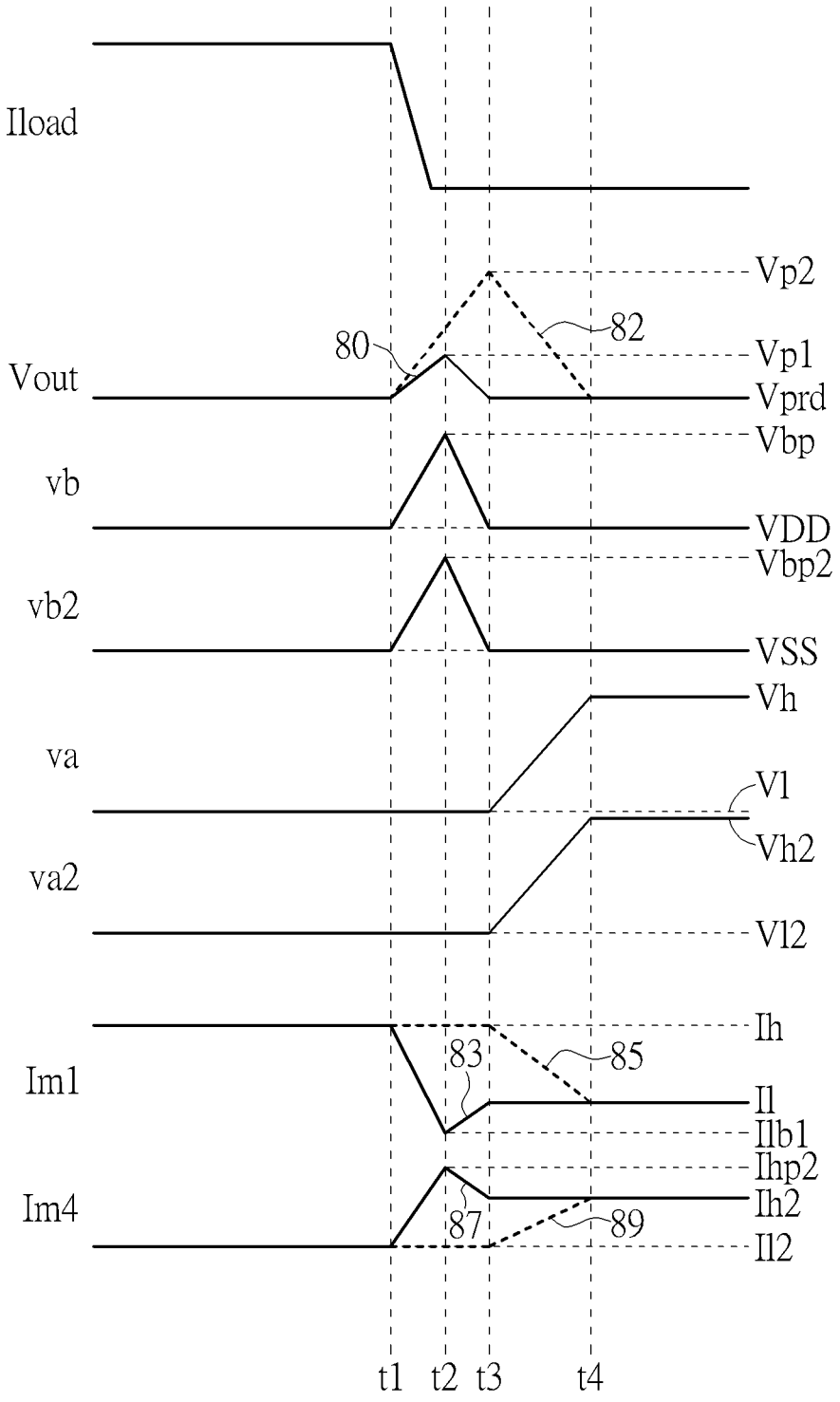
FIG. 8 is waveforms of the voltage regulator in FIG. 7 represented as an exemplary load change condition.

FIG. 8 is waveforms of the voltage regulator 7 represented as an exemplary load change condition. The lines 80 and 82 represent waveforms of the output voltages Vout in the present embodiment and in the related art, respectively; the lines 83 and 85 represent waveforms of the current Im1 of the transistor M1 in the present embodiment and in the related art, respectively; the lines 87 and 89 represent waveforms of the current Im4 of the transistor M4 in the present embodiment and in the related art, respectively.

In the embodiment, at Time t1, the load condition is switched from the heavy load condition to the light load condition. In between Time t1 and Time t2, the load L draws a reduced amount of the current Iload, the waveform 80 of the output voltage Vout rises from the predetermined level Vprd to an output peak level Vp1, the bulk voltage vb of the transistor M1 increases from the supply voltage VDD to the bulk peak level Vbp, the bulk voltage vb2 of the transistor M4 increases from the ground voltage VSS to a bulk peak level Vbp2, the first control voltage va remains at the voltage level Vl, the second control voltage va2 remains at the voltage level V12, the current Im1 decreases from the current level Ih to the current level Ilb1 in response to the increase of the bulk voltage vb of the transistor M1, and the current Im4 increases from a current level 112 to a current level Ihp2 in response to the increase of the bulk voltage vb2 of the transistor M4, suppressing the rise in the waveform 80 of the output voltage Vout. The ground voltage VSS may be the steady-state level of the bulk voltage vb2 of the transistor M4. In between Time t2 and Time t3, the current Im1 rises from the current level Ilb1 to a current level Il, the current Im4 falls from the current level Ihp2 to a current level Ih2, the output voltage Vout drops from the output peak level Vp1, the bulk voltage vb of the transistor M1 drops from the bulk peak level Vbp to the supply voltage VDD, the bulk voltage vb2 of the transistor M4 drops from the bulk peak level Vbp2 to the ground voltage VSS, the first control voltage va remains at the voltage level Vl, and the second control voltage va2 remains at the voltage level V12, pulling the waveform 80 of the output voltage Vout to the predetermined level Vprd. In between Time t3 and Time t4, the first control voltage va rises from the voltage level Vl to the voltage level Vh, and the second control voltage va2 rises from the voltage level V12 to the voltage level Vh2, the current Im1 remains at the current level Il and the current Im4 remains at the current level Ih2, and the output voltage Vout remains at the predetermined level Vprd. The voltage level Vl may be the same as or different from the voltage level V12, and the voltage level Vh may be the same as or different from the voltage level Vh2. After Time t4, the current Im1 remains at the current level Il and the current Im4 remains at the current level Ih2, and the output voltage Vout remains at the predetermined level Vprd.

In the related art, in between Time t1 and Time t3, the waveform 82 of the output voltage Vout rises from the predetermined level Vprd to an output peak level Vp2, the waveform 85 of the current Im1 remains at the current level Ih, and the waveform 89 of the current Im4 remains at the current level 112. The output peak level Vp2 of the waveform 82 may be higher than the output peak level Vp1 of the waveform 80. In between Time t3 and Time t4, the waveform 85 of the current Im1 falls from the current level Ih to the current level Il, and the waveform 89 of the current Im4 rises from the current level 112 to the current level Ih2, the first control voltage va rises from the voltage level Vl to the voltage level Vh, and the second control voltage va2 rises from the voltage level V12 to the voltage level Vh2, bringing the waveform 82 of the output voltage Vout down to the predetermined level Vprd. In comparison to the related art, the waveform 80 of the output voltage Vout is brought back to the predetermined level Vprd at Time t3, and the waveform 82 of the output voltage Vout is brought back to the predetermined level Vprd at Time t4, and thus the present embodiment responds to the change in the load condition in a prompter manner than the related art.

Figure 9:
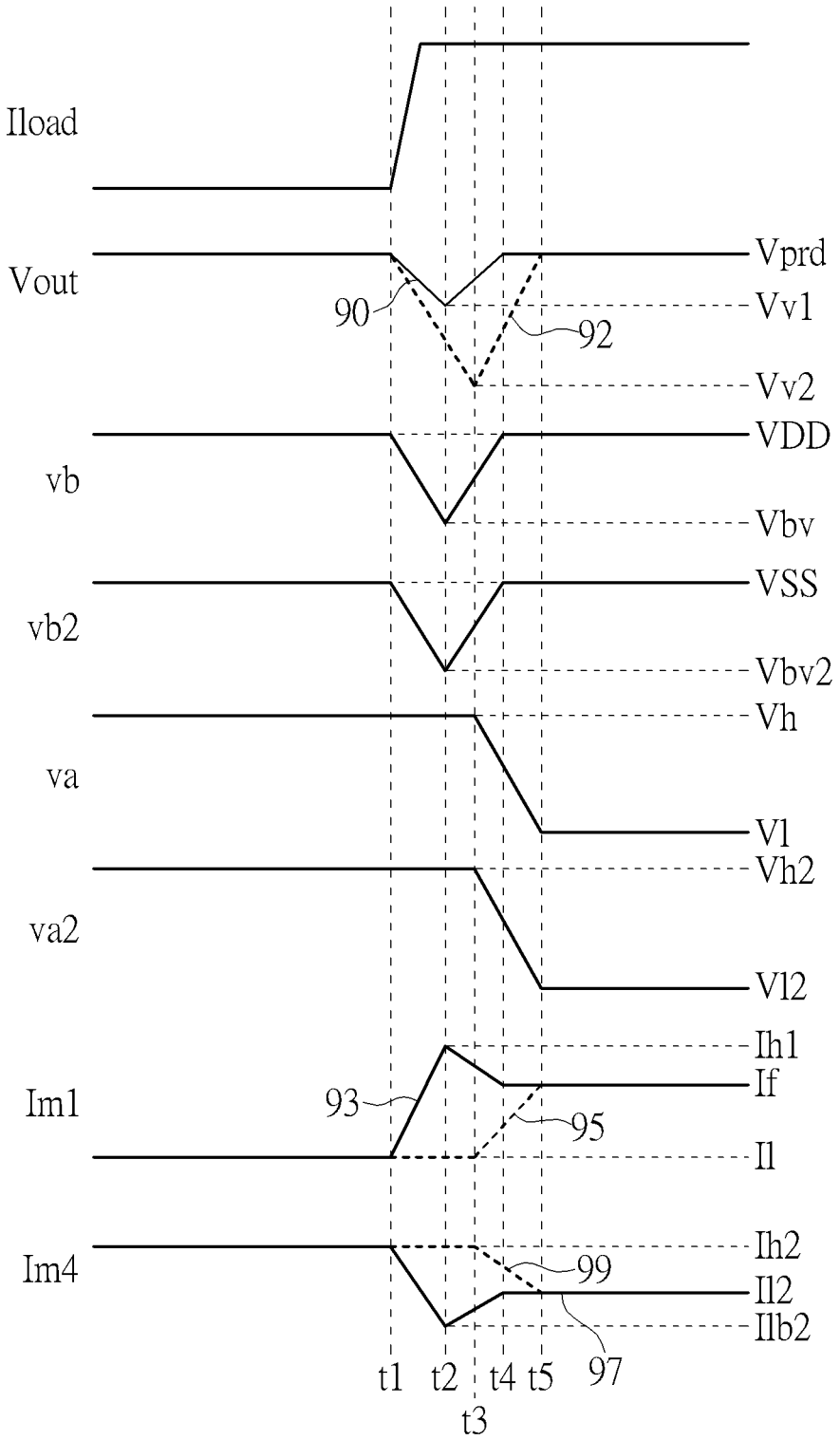
FIG. 9 is waveforms of the voltage regulator in FIG. 7 represented as another exemplary load change condition.

FIG. 9 is waveforms of the voltage regulator 7 represented as another exemplary load change condition. The lines 90 and 92 represent waveforms of the output voltages Vout in the present embodiment and in the related art, respectively; the lines 93 and 95 represent waveforms of the current Im1 of the transistor M1 in the present embodiment and in the related art, respectively; the lines 97 and 99 represent waveforms of the current Im4 of the transistor M4 in the present embodiment and in the related art, respectively.

In the embodiment, at Time t1, the load condition is switched from the light load condition to the heavy load condition. In between Time t1 and Time t2, the load L draws an increased amount of the current Iload, the waveform 90 of the output voltage Vout drops from the predetermined level Vprd to an output valley level Vv1, the bulk voltage vb of the transistor M1 decreases from the supply voltage VDD to the bulk valley level Vbv, the bulk voltage vb2 of the transistor M4 decreases from the ground voltage VSS to a second bulk valley level Vbv2, the first control voltage va and the second control voltage va2 remains at the voltage level Vh and Vh2, respectively, the current Im1 rises from a current level Il to a current level Ih1 in response to the decrease of the bulk voltage vb of the transistor M1, and the current Im4 drops from the current level Ih2 to the current level Ilb2, compensating for the drop in the waveform 90 of the output voltage Vout. In between Time t2 and Time t3, the waveform 90 of the output voltage Vout rises from the output valley level Vv1, the bulk voltage vb of the transistor M1 rises from the bulk valley level Vbv, the bulk voltage vb2 of the transistor M4 rises from the second bulk valley level Vbv2, the first control voltage va and the second control voltage va2 remain at the voltage level Vh and Vh2, respectively, the current Im1 drops from the current level Ih1, and the current Im4 rises from the current level Ilb2, pulling the waveform 90 of the output voltage Vout towards the predetermined level Vprd. In between Time t3 and Time t4, the waveform 90 of the output voltage Vout rises to the predetermined level Vprd, the bulk voltage vb of the transistor M1 rises to the supply voltage VDD, the bulk voltage vb2 of the transistor M4 rises to the ground voltage VSS, the first control voltage va and the second control voltage va2 drop from the voltage level Vh and Vh2, respectively, towards the voltage level Vl and V12, respectively, the current Im1 drops to a current level If, and the current Im4 rises to the current level 112, pulling the waveform 90 of the output voltage Vout to the predetermined level Vprd.

In the related art, in between Time t1 and Time t3, the waveform 92 of the output voltage Vout drops from the predetermined level Vprd to an output valley level Vv2, the waveform 95 of the current Im1 remains at the current level Il, and the waveform 99 of the current Im4 remains at the current level Ih2, and the first control voltage va and the second control voltage va2 remain at the voltage level Vh and Vh2, respectively. The output valley level Vv2 of the waveform 92 may be lower than the output valley level Vv1 of the waveform 90. In between Time t3 and Time t5, the waveform 95 of the current Im1 rises from the current level Il to the current level If, and the waveform 99 of the current Im4 falls from the current level Ih2 to the current level 112, the first control voltage va drops from the voltage level Vh to the voltage level Vl, and the second control voltage va2 drops from the voltage level Vh2 to the voltage level V12, and the waveform 92 of the output voltage Vout rises from the output valley level Vv2 to the predetermined level Vprd. In comparison to the related art, the waveform 90 of the output voltage Vout is brought back to the predetermined level Vprd at Time t4, and the waveform 92 of the output voltage Vout is brought back to the predetermined level Vprd at Time t5, and thus the present embodiment responds to the change in the load condition in a prompter manner than the related art.

Figure 10:
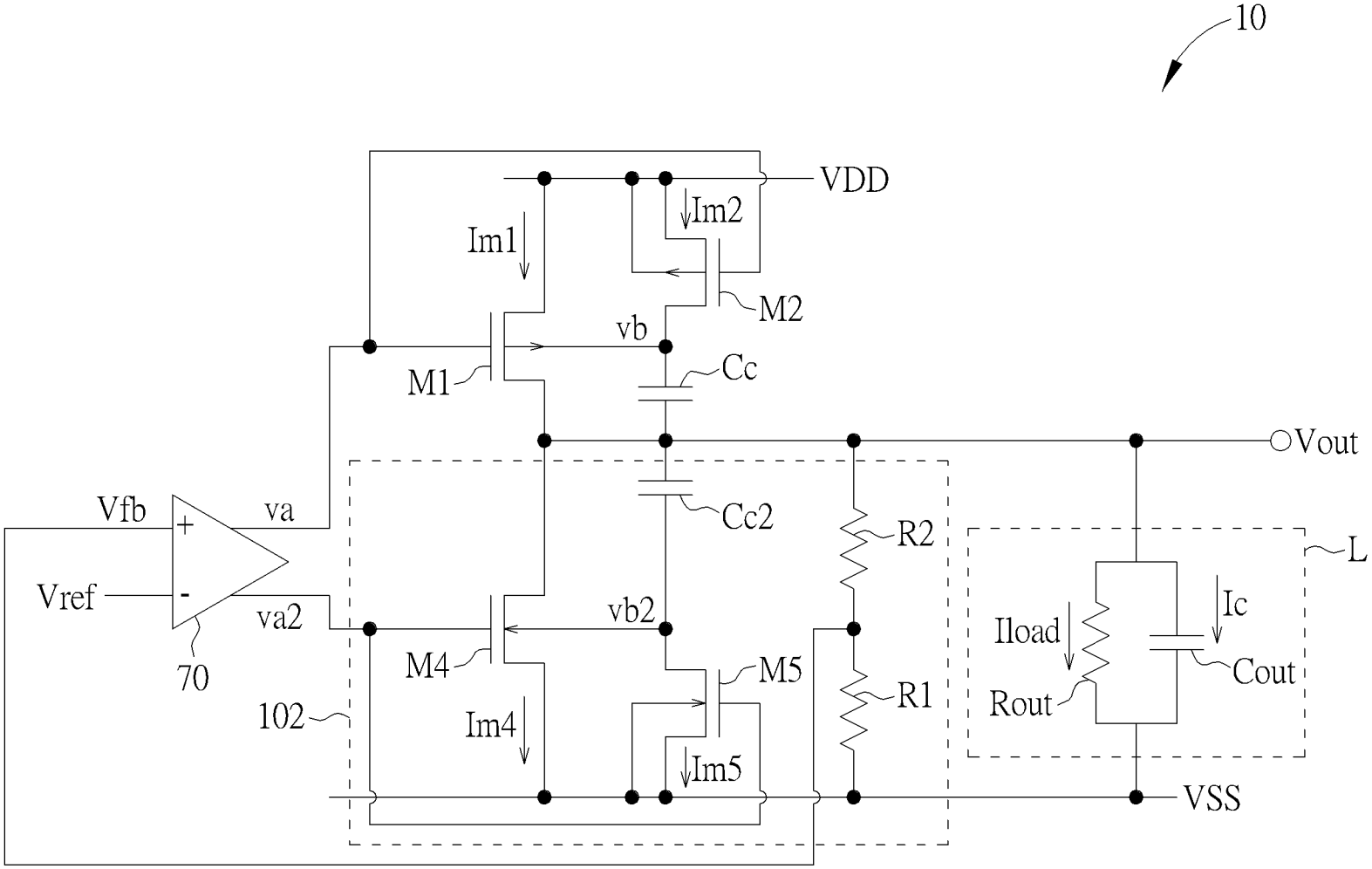
FIG. 10 is a circuit schematic of a voltage regulator according to another embodiment of the invention.

FIG. 10 is a circuit schematic of a voltage regulator 10 according to another embodiment of the invention. The voltage regulator 10 is different from the voltage regulator 7 in that a current sink circuit 102 is used to replace the current sink circuit 72. The voltage regulator 10 operates in a manner similar to the voltage regulator 7, and explanation therefor will be omitted for brevity. The current sink circuit 102 will be explained in details in the following paragraphs.

The current sink circuit 102 includes a transistor M4, a transistor M5, a capacitor Cc2, a resistor R1 and a resistor R2. The transistor M4 includes a control terminal coupled to the second output terminal of the operational amplifier 70, a first terminal coupled to the second terminal of the transistor M1, a second terminal coupled to a ground terminal, and a bulk terminal. The first terminal of the transistor M4 provides the output voltage Vout to the load terminal. The transistor M5 includes a control terminal coupled to the second output terminal of the operational amplifier 70, a first terminal coupled to the bulk terminal of the transistor M4, a second terminal coupled to the ground terminal, and a bulk terminal coupled to the ground terminal. The capacitor Cc2 includes a first terminal coupled to the first terminal of the transistor M4, and a second terminal coupled to the bulk terminal of the transistor M4 and the first terminal of the transistor M5. The resistor R2 includes a first terminal coupled to the second terminal of the transistor M1 and the second terminal of the capacitor Cc, and the second terminal. The resistor R1 includes a first terminal coupled to the second terminal of the resistor R2 and the second input terminal of the operational amplifier 70, and a second terminal coupled to the ground terminal. The first terminal of the resistor R1 may deliver the feedback voltage Vfb to the operational amplifier 10. The feedback voltage Vfb may be positively correlated to the output voltage Vout and less than the output voltage Vout. In some embodiments, the resistor R1 and the resistor R2 may be implemented by transistors. The regulator gain of the voltage regulator 10 may be determined by Equation (3). The transistor M1 and the transistor M2 may be P-type MOSFETs, and the transistor M4 and transistor M5 may be N-type MOSFETs.

In comparison to the embodiments represented in FIGS. 1, 4 and 5, the voltage regulators 7 and 10 are more responsive to the sudden rise in the output voltage Vout by providing the transistor M4 in the current sink path.

Figure 11:
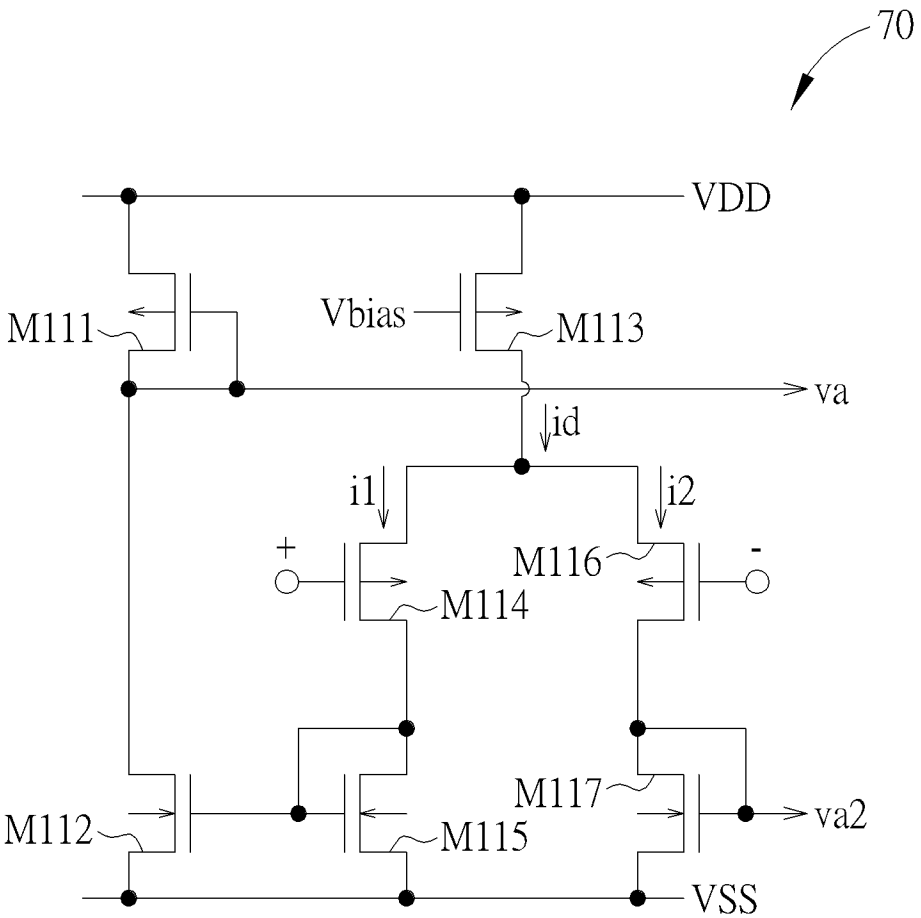
FIG. 11 is a circuit schematic of the operational amplifier according to embodiments illustrated in FIGS. 7 and 10.

FIG. 11 is a circuit schematic of one example of the operational amplifier 70 according to embodiments illustrated in FIGS. 7 and 10. The operational amplifier 70 may include transistors M111 to M117. The transistors M111, M113, M114, M116 may be P-type MOSFETs, and the transistors M112, M115, M117 may be N-type MOSFETs.

The transistor M113 includes a control terminal receiving a fixed bias voltage Vbias, a first terminal coupled to the supply terminal and a second terminal. The transistor M111 includes a control terminal, a first terminal coupled to the supply terminal, and a second terminal coupled to the control terminal of the transistor M111. The transistor M114 includes a control terminal coupled to the first input terminal of the operational amplifier 70, a first terminal coupled to the second terminal of the transistor M113, and a second terminal. The transistor M116 includes a control terminal coupled to the second input terminal of the operational amplifier 70, a first terminal coupled to the second terminal of the transistor M113, and a second terminal. The transistor M115 includes a control terminal, a first terminal coupled to the control terminal of the transistor M115 and the second terminal of the transistor M114, and a second terminal coupled to the ground terminal. The transistor M117 includes a control terminal, a first terminal coupled to the control terminal of the transistor M117 and the second terminal of the transistor M116, and a second terminal coupled to the ground terminal. The transistor M112 includes a control terminal coupled to the control terminal of the transistor M115, a first terminal coupled to the second terminal of the transistor M111, and a second terminal coupled to the ground terminal.

The transistor M113 may serve as a current source receiving a fixed bias voltage Vbias to generate a fixed drain current id. The drain current id of the transistor M113 may be split into a first current it flowing through the transistors M114 and M115 and a second current i2 flowing through the transistors M116 and M117. The operational amplifier 70 may receive the reference voltage Vref at the control terminal of the transistor M114, receive the feedback voltage Vfb at the control terminal of the transistor M116, output the first control voltage va at the second terminal of the transistor M111, and output the second control voltage va2 at the control terminal of the transistor M117. The transistors M115 and M112 may serve as a current mirror. The transistor M111 may serve as a current source. The sum of the first current i1 and the second current i2 is equal to the drain current id of the transistor M113. When the feedback voltage Vfb decreases, the second current i2 generated by the transistor M116 may decrease, resulting in an increase in the first current i1. The increase in the first current i1 may generate a decrease in the first control voltage va via the transistors M115, M112 and M111, and the decrease in the second current i2 may be converted into a decrease in the second control voltage va2 via the transistor M117. When the feedback voltage Vfb increases, the second current i2 generated by the transistor M116 may increase, resulting in a decrease in the first current i1. The decrease in the first current i1 may generate an increase in the first control voltage va via the transistors M115, M112 and M111, and the increase in the second current i2 may be converted into an increase in the second control voltage va2 via the transistor M117.

The embodiments in FIGS. 7 and 10 provide a current source path and a current sink path to reduce rises and drops in the output voltage Vout, and employ the transistor M2 and the capacitor Cc to adjust the bulk voltage vb of the transistor M1 in the current source path, and the transistor M5 and the capacitor Cc2 to adjust the bulk voltage vb2 of the transistor M4 in the current sink path, so as to further speed up circuit response to maintain the output voltage Vout at a substantially constant level.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage regulator comprising:

an operational amplifier comprising a first input terminal, a second input terminal and an output terminal, wherein the output terminal outputs a control voltage according to an amplified differential voltage between the first input terminal and the second input terminal;

a first transistor comprising a control terminal coupled to the output terminal of the operational amplifier, a first terminal coupled to a supply terminal, a second terminal providing an output voltage to a load terminal, and a bulk terminal;

a second transistor comprising a control terminal coupled to the output terminal of the operational amplifier, a first terminal coupled to the supply terminal, a second terminal coupled to the bulk terminal of the first transistor, and a bulk terminal coupled to the supply terminal;

a first capacitor comprising a first terminal directly connected to the bulk terminal of the first transistor and the second terminal of the second transistor, and a second terminal directly connected to the second terminal of the first transistor; and a current sink circuit coupled to the second terminal of the first transistor, the second terminal of the first capacitor, the second input terminal of the operational amplifier and a ground terminal.

2. The voltage regulator of claim 1, wherein the current sink circuit comprises a resistor comprising a first terminal coupled to the second terminal of the first transistor, the second terminal of the first capacitor and the second input terminal of the operational amplifier, and a second terminal coupled to the ground terminal.

3. The voltage regulator of claim 1, wherein the current sink circuit comprises a third transistor comprising a first terminal coupled to the second terminal of the first transistor, the second terminal of the first capacitor and the second input terminal of the operational amplifier, a second terminal coupled to the ground terminal, a control terminal receiving a fixed bias voltage, and a bulk terminal.

4. The voltage regulator of claim 3, wherein the third transistor is an N-type metal oxide semiconductor field effect transistor (MOSFET).

5. The voltage regulator of claim 1, wherein the current sink circuit comprises:

a first resistor comprising a first terminal coupled to the second terminal of the first transistor and the second terminal of the first capacitor, and a second terminal; and a second resistor comprising a first terminal coupled to the second terminal of the first resistor and the second input terminal of the operational amplifier, and a second terminal coupled to the ground terminal.

6. The voltage regulator of claim 1, wherein the first transistor and the second transistor are P-type MOSFETs.

7. The voltage regulator of claim 1, wherein the first input terminal of the operational amplifier is an inverting input terminal, the second input terminal of the operational amplifier is a non-inverting input terminal.

8. The voltage regulator of claim 1, wherein the first input terminal of the operational amplifier receives a fixed reference voltage.

9. A voltage regulator comprising:

an operational amplifier comprising a first input terminal, a second input terminal, a first output terminal and a second output terminal, wherein the first output terminal outputs a first control voltage according to an amplified differential voltage between the first input terminal and the second input terminal, and the second output terminal outputs a second control voltage according to the amplified differential voltage between the first input terminal and the second input terminal;

a first transistor comprising a control terminal coupled to the first output terminal of the operational amplifier, a first terminal coupled to a supply terminal, a second terminal providing an output voltage to a load terminal, and a bulk terminal;

a second transistor comprising a control terminal coupled to the first output terminal of the operational amplifier, a first terminal coupled to the supply terminal, a second terminal coupled to the bulk terminal of the first transistor, and a bulk terminal coupled to the supply terminal;

a first capacitor comprising a first terminal directly connected to the bulk terminal of the first transistor and the second terminal of the second transistor, and a second terminal directly connected to the second terminal of the first transistor; and a current sink circuit coupled to the second terminal of the first transistor, the second terminal of the first capacitor, the second input terminal of the operational amplifier, the second output terminal of the operational amplifier and a ground terminal.

10. The voltage regulator of claim 9, wherein the current sink circuit comprises:

a third transistor comprising a control terminal coupled to the second output terminal of the operational amplifier, a first terminal coupled to the second terminal of the first transistor, a second terminal coupled to a ground terminal, and a bulk terminal, wherein the first terminal of the third transistor provides the output voltage to the load terminal;

a fourth transistor comprising a control terminal coupled to the second output terminal of the operational amplifier, a first terminal coupled to the bulk terminal of the third transistor, a second terminal coupled to the ground terminal, and a bulk terminal coupled to the ground terminal; and a second capacitor comprising a first terminal coupled to the first terminal of the third transistor, and a second terminal coupled to the bulk terminal of the third transistor and the first terminal of the fourth transistor;

wherein the second terminal of the first transistor and the first terminal of the third transistor provide a feedback voltage to the second input terminal of the operational amplifier.

11. The voltage regulator of claim 10, wherein the first transistor and the second transistor are P-type MOSFETs, the third transistor and fourth transistor are N-type MOSFETs.

12. The voltage regulator of claim 9, wherein the current sink circuit comprises:

a third transistor comprising a control terminal coupled to the second output terminal of the operational amplifier, a first terminal coupled to the second terminal of the first transistor, a second terminal coupled to a ground terminal, and a bulk terminal, wherein the first terminal of the third transistor provides the output voltage to the load terminal;

a fourth transistor comprising a control terminal coupled to the second output terminal of the operational amplifier, a first terminal coupled to the bulk terminal of the third transistor, a second terminal coupled to the ground terminal, and a bulk terminal coupled to the ground terminal;

a second capacitor comprising a first terminal coupled to the first terminal of the third transistor, and a second terminal coupled to the bulk terminal of the third transistor and the first terminal of the fourth transistor;

a first resistor comprising a first terminal coupled to the second terminal of the first transistor and the second terminal of the first capacitor, and a second terminal; and a second resistor comprising a first terminal coupled to the second terminal of the first resistor and the second input terminal of the operational amplifier, and a second terminal coupled to the ground terminal.

13. The voltage regulator of claim 12, wherein the first transistor and the second transistor are P-type MOSFETs, the third transistor and fourth transistor are N-type MOSFETs.

14. The voltage regulator of claim 9, wherein the first input terminal of the operational amplifier is an inverting input terminal, the second input terminal of the operational amplifier is a non-inverting input terminal.

15. The voltage regulator of claim 9, wherein the first input terminal of the operational amplifier receives a fixed reference voltage.

* * * * *